US005282538A

United States Patent [19]

Moys

[11] Patent Number: 5,282,538

[45] Date of Patent: Feb. 1, 1994

[54] FLOTATION COLUMN

[75] Inventor: Michael H. Moys, Halfway House, South Africa

[73] Assignee: Multotec Cyclones (Proprietary) Limited, Transvaal, South Africa

[21] Appl. No.: 909,542

[22] Filed: Jul. 6, 1992

Related U.S. Application Data

[62] Division of Ser. No. 784,853, Oct. 30, 1991, abandoned.

[30] Foreign Application Priority Data

Oct. 31, 1990 [ZA] South Africa ..... 90/8733

[51] Int. Cl.[5] ..... B03D 1/02; B03D 1/24

[52] U.S. Cl. ..... 209/164; 209/170; 261/123; 261/124

[58] Field of Search ..... 209/168, 169, 170; 210/221.2; 261/122, 123, 124

[56] References Cited

U.S. PATENT DOCUMENTS

| | | | |
|---|---|---|---|
| 1,317,244 | 9/1919 | Towne et al. | 209/170 |
| 1,319,208 | 10/1919 | Cole | 209/170 |
| 1,362,370 | 12/1920 | Terry, Jr. | 209/170 |
| 1,375,211 | 4/1921 | Cole | 209/170 |
| 2,073,148 | 3/1937 | Gayford et al. | 209/168 |
| 2,274,401 | 2/1942 | Dromgold | 261/93 |
| 2,758,714 | 8/1956 | Hollingsworth | 209/168 |
| 2,778,499 | 1/1957 | Chamberlain et al. | 209/166 |
| 3,037,626 | 6/1962 | Takahashi | 209/164 |
| 3,371,779 | 3/1968 | Hollingsworth et al. | 209/166 |
| 3,642,618 | 2/1972 | Silva | 210/44 |
| 4,049,553 | 9/1977 | Stebbins | 209/170 |
| 4,220,612 | 9/1980 | Degner | 209/170 |
| 4,226,706 | 10/1980 | Degner | 209/170 |
| 4,255,262 | 3/1981 | Ocheskey | 209/170 |
| 4,347,127 | 8/1982 | Duttera et al. | 209/164 |
| 4,534,862 | 8/1985 | Zlokarnik | 209/170 |
| 4,564,457 | 1/1986 | Cairo | 209/170 |
| 4,613,431 | 9/1986 | Miller | 209/169 |
| 4,668,382 | 5/1987 | Jameson | 209/164 |
| 4,782,789 | 11/1988 | Canzoneri | 209/170 |
| 4,824,579 | 4/1989 | George | 209/170 |
| 4,931,175 | 6/1990 | Krofta | 210/86 |
| 4,950,390 | 8/1990 | Szentlaszloi et al. | 209/164 |
| 4,960,509 | 10/1990 | McNeill | 209/164 |

FOREIGN PATENT DOCUMENTS

| | | | |
|---|---|---|---|
| 229224 | 7/1987 | European Pat. Off. | 209/168 |
| 10202 | 11/1989 | PCT Int'l Appl. | 209/170 |
| 599849 | 3/1978 | U.S.S.R. . | |
| 785205 | 12/1980 | U.S.S.R. . | |
| 1215750 | 3/1986 | U.S.S.R. . | |
| 1233947 | 5/1986 | U.S.S.R. . | |

*Primary Examiner*—Thomas M. Lithgow
*Attorney, Agent, or Firm*—Pennie & Edmonds

[57] ABSTRACT

A flotation method for separating particulate material including at least two separate passageways within each of which slurry is separated from froth by an interface, a feed supply within each passageway for feeding the slurry into each passageway below the interface, bubble generator located below or within the passageways, and at least one tailings outlet below the bubble generator.

7 Claims, 4 Drawing Sheets

FLOTATION COLUMN

This is a division of application Ser. No. 07/784,853, filed Oct. 30, 1991 (now abandoned).

FIELD OF THE INVENTION

This invention relates to a flotation column and to a method of separating particulate material in a flotation column.

DESCRIPTION OF THE PRIOR ART

Large unbaffled columns are subject to severe axial mixing or recirculation. It has generally been assumed that such columns should be baffled by vertical baffles located wholly within the slurry phase to reduce axial mixing. The Applicant has found that these baffles do not prevent axial mixing from taking place and that in some instances they enhance axial mixing.

Axial mixing results in a reduced residence time of some of the particulate material within the column leading to a poor recovery rate. It is for this reason that flotation columns have generally only been used as cleaners and not as roughers or scavengers.

OBJECT OF THE INVENTION

It is an object of this invention to provide a flotation column and a method of separating particulate material which at least reduce axial mixing associated with prior art flotation columns.

SUMMARY OF THE INVENTION

According to the invention a flotation column for separating particulate material includes at least two separate passageways within each of which slurry is in use separated from froth by an interface, feed means within each passageway for feeding the slurry into each passageway below the interface, bubble generating means located below or within the passageways, and at least one tailings outlet below the bubble generating means.

In the preferred form of the invention control means is provided for controlling the positions of the interfaces.

In one form of the invention the control means may be valves for manipulating the flow of fluid or particulate material to or from the column.

The froth zones may merge to form a common froth zone.

The separate passageways may be formed by at least one baffle. The baffle may extend from above the outlet so that the passageways have a common outlet. The top of the baffle may terminate at the froth overflow zone or above at least part of the froth overflow zone.

The separate passageways may include at least one closable opening through which the passageways can communicate with one another. Circulation may take place through this opening. The circulation can be used to control the relative levels of the interfaces. The opening may be closable by a gate located in the baffle.

According to another aspect of the invention a flotation column for separating particulate material includes at least one continuous baffle which creates at least two separate passageways in each of which slurry is in use separated from froth by an interface, the top of the baffle terminating at the froth overflow zone or above at least part of the froth overflow zone.

According to another aspect of the invention a method of separating particulate material within a flotation column having at least two separate passageways includes the step of creating a slurry phase and a froth phase within each passageway, with the phases in each passageway being separated by an interface located within each passageway.

The method preferably includes the step of controlling the positions of the interfaces within each passageway by manipulating the flow of fluid or particulate material to or from the column. In one form of the invention the position of one of the interfaces is controlled by controlling the flow of slurry from the column, and the positions of the other interfaces are controlled by allowing circulation between a closable opening between the passageways or by adjusting the performance of the bubble generating means.

DETAILED DESCRIPTION OF THE INVENTION

Figure 1:
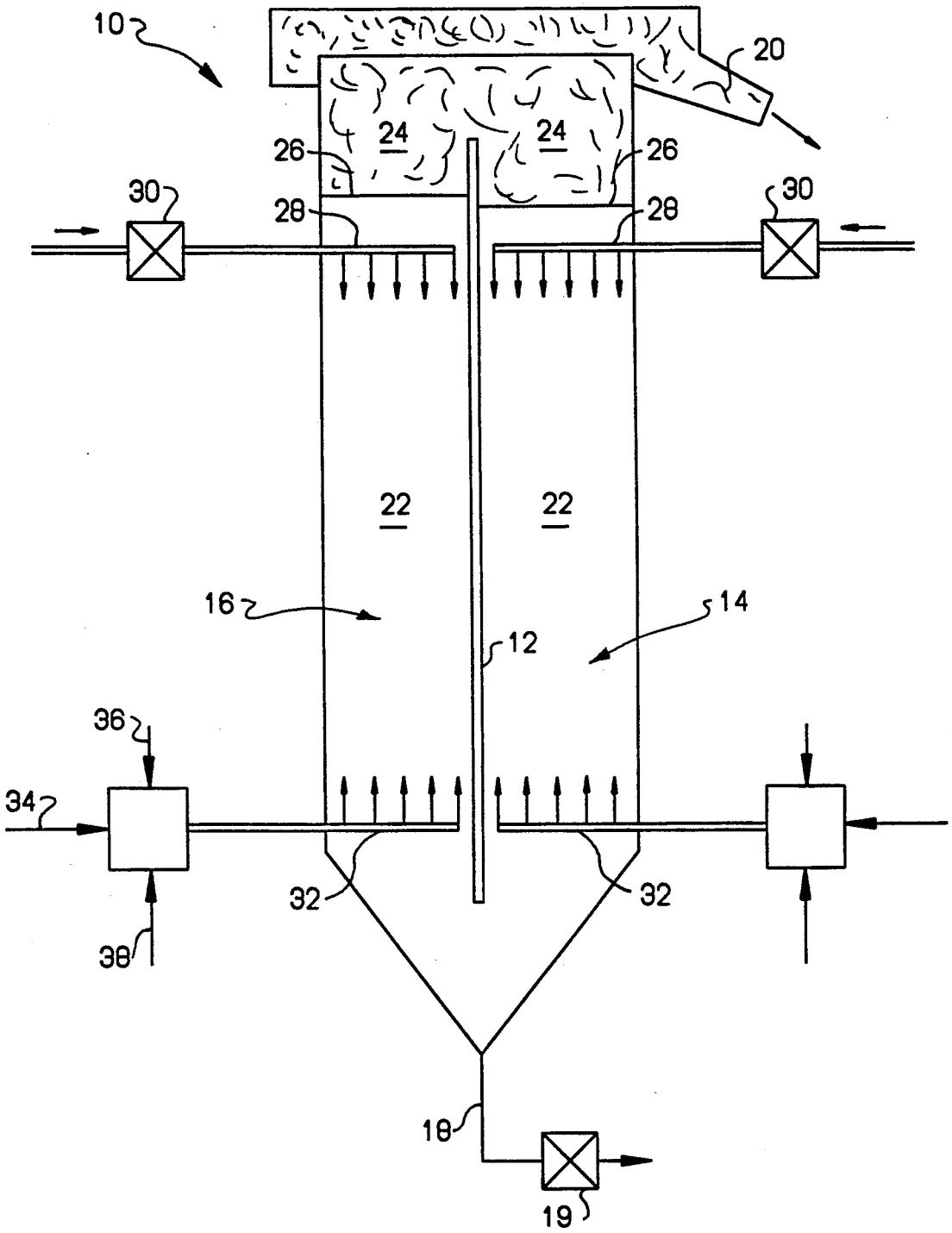
Figure 2:
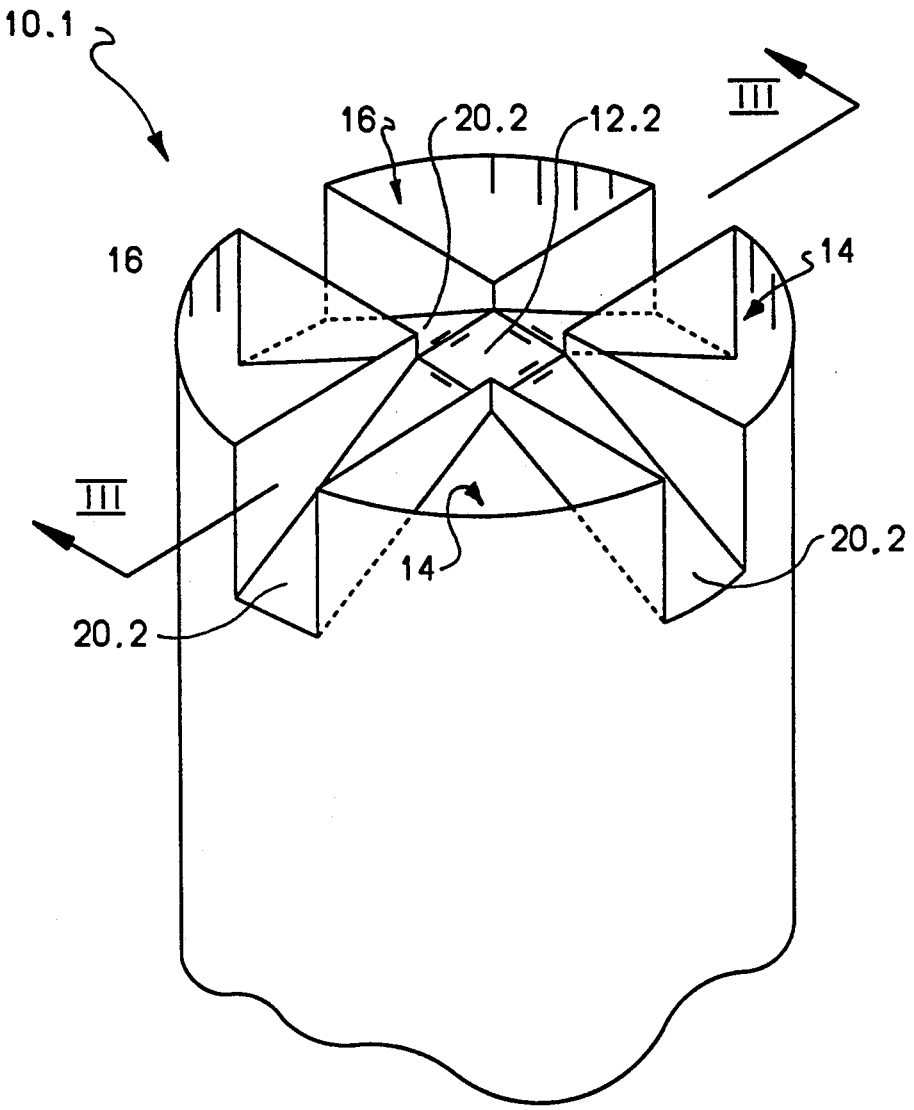
Figure 3:
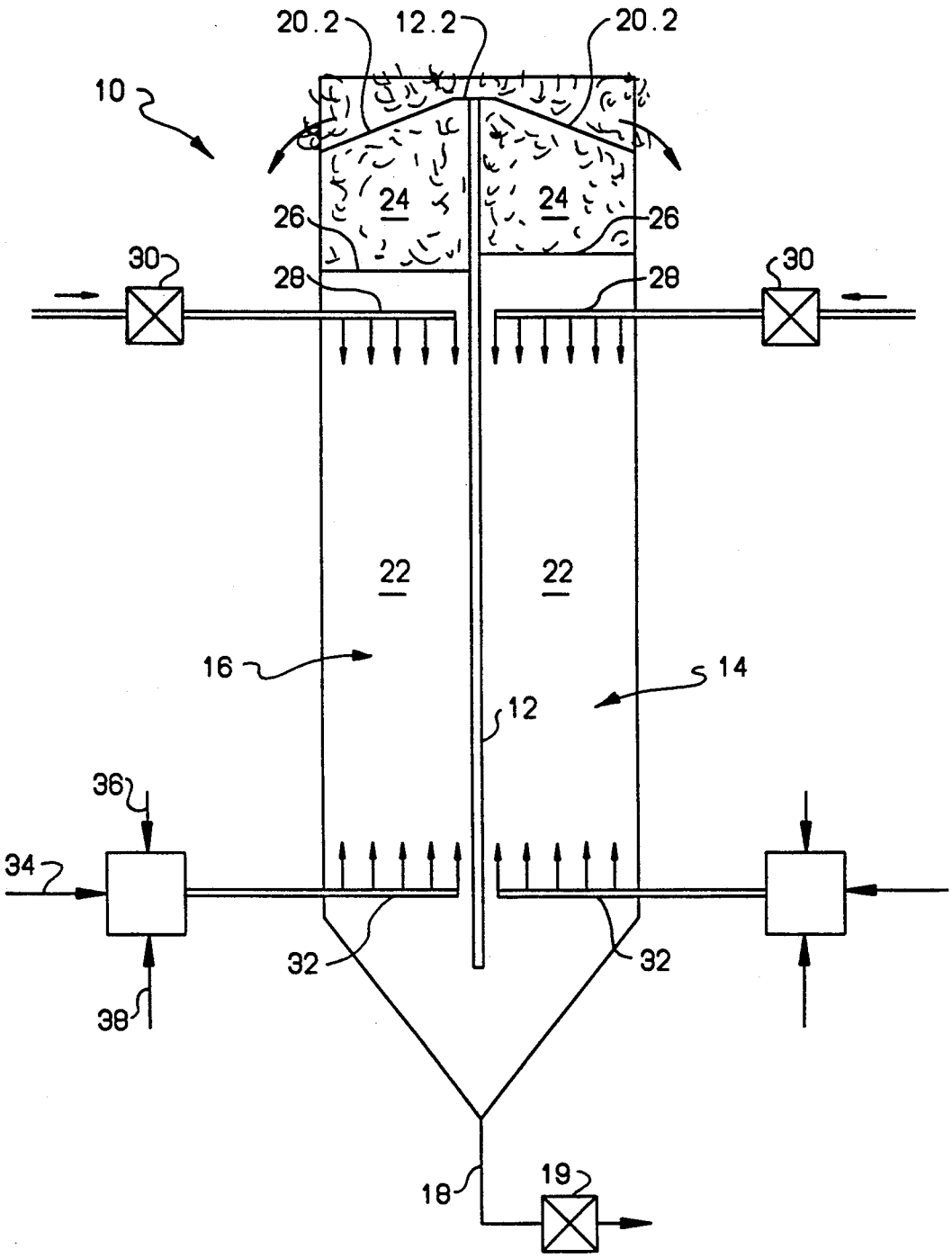
Figure 4:
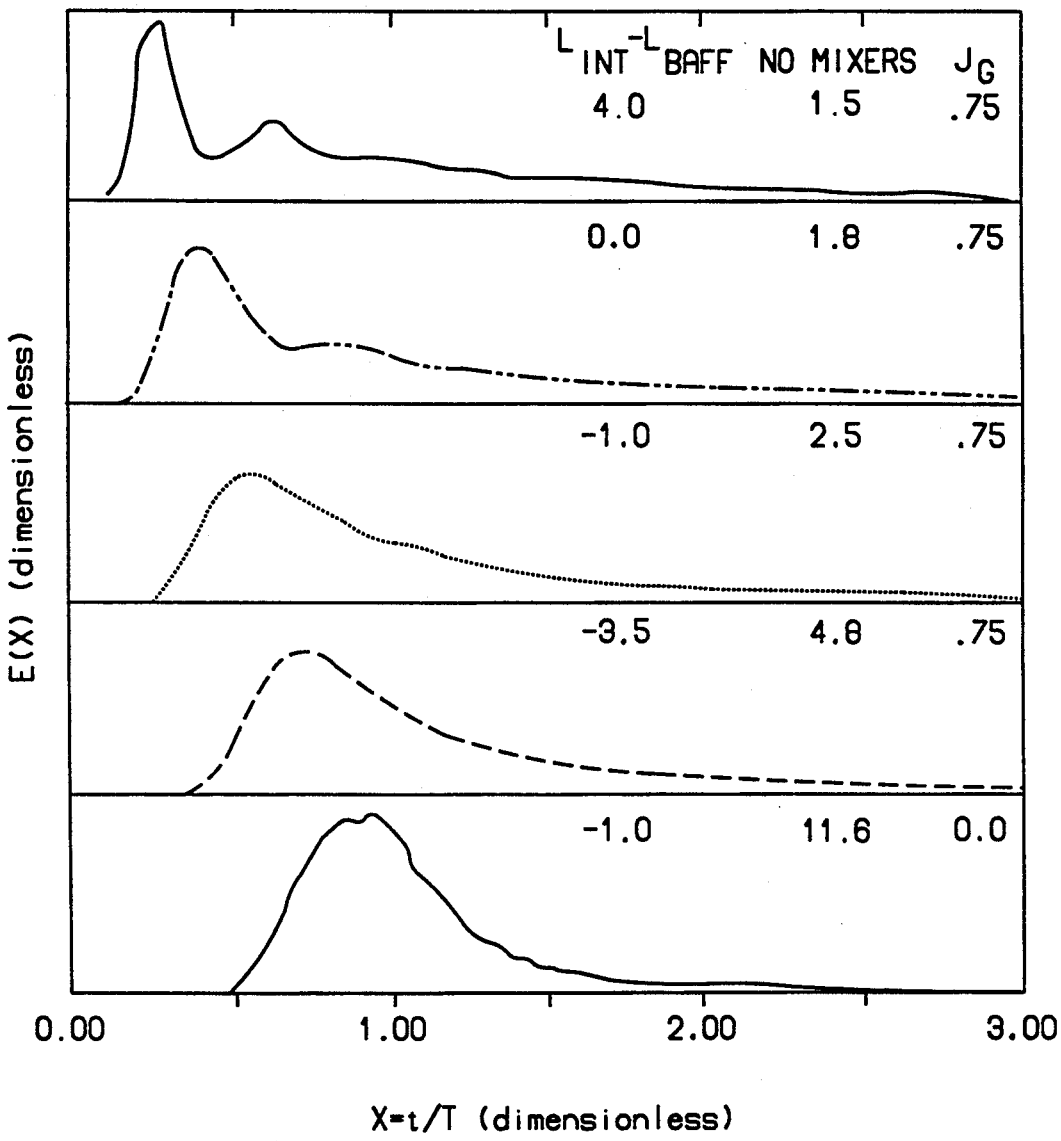

The invention will now be described by way of a non-limiting examples with reference to the accompanying drawings in which:

FIG. 1 is a cross-sectional side view of a flotation column according to the invention; and FIG. 2 is a perspective view of part of a flotation column according to another form of the invention; and FIG. 3 is a cross-sectional side view on line III—III of the flotation column shown in FIG. 2; and FIG. 4 is a graph showing the effect of the interface position relative to the baffles on the residence time distribution.

Referring to FIG. 1, a flotation column 10 includes a baffle 12 which divides part of the column 10 into two separate passageways 14 and 16. The passageways have a common tailings outlet 18 and a common froth overflow 20. The outlet 18 is provided with a valve 19.

Each passageway has a slurry phase 22 separated from a froth phase 24 by an interface 26. Furthermore, each passageway has its own slurry supply 28 which can be controlled by a valve 30. In addition each passageway has its own bubble generator 32. Each bubble generator is connected to an air supply 34, a water supply 36 and a frother supply 38.

The positions of the interfaces 26 are controlled so as to be level with one another or as close to level with one another as possible. One of the interface levels is controlled by varying the tailings rate. The level of the other interface is controlled by controlling one or more of the following: the output from the bubble generator, the slurry supply to the passageways or the circulation between the passageways through closable openings (not shown) in the baffle.

Although also not shown, probes are provided for monitoring the pressure a short distance below the interfaces. The outputs from the probes may be used automatically to vary the bubble and/or slurry feed to the passageways. Thus the interfaces can be kept level with one another automatically. Various other methods could of course be used for sensing the interface level in each passageway.

By ensuring that the interfaces 26 are located below the top of the baffle 12, the column is effectively divided into two individual columns. This eliminates recirculation or axial mixing of the slurry between the two passageways.

Referring now to FIGS. 2 and 3 in which the same numerals refer to the same parts of FIG. 1, the top 12.2 of the baffle 12.1 terminates at the top of the froth overflow 20.2 of the flotation column 10.1.

The applicant conducted five experiments using a flotation column in which the height of baffles relative to the position of the interfaces could be varied.

For each experiment a tracer (3 g of NaCl dissolved in 200 ml water) was inserted into the slurry supply. The tracer concentration was then measured by a conductivity probe at the tailings outlet of the column to determine the residence time distribution of the tracer within the column. In the first experiment the interfaces were located four centimeters above the top of the baffle. In the second experiment the interfaces were level with the top of the baffle, thereafter the interfaces were 1 cm; 3,5 cm and 1 cm respectively below the top of the baffle. The gas superficial velocity (JG), which is a measure of the gas rate, was kept constant at 0.75 cm/s for each experiment except for the last experiment where it was 0 cm/s.

The results of the experiments are shown by way of five graphs in FIG. 3. The top graph relates to the first experiment and the bottom graph to the fifth experiment. In FIG. 4, E(X) indicates the residence time distribution; t indicates time; $X=t/T$ indicates the normalised residence time; T indicates the average residence time; and LINT−LBAFF is the difference in height between the interfaces and the baffle. The residence time distribution E(X) is defined as E(X)dX which is the fraction of the tracer which spends a time between X and XtdX in the column where dX is a small time increment.

The experiment showed that the residence time distribution of the tracer within the column improved as the height of the baffle was raised relative to the interfaces. The time taken for the fastest moving tracer to move from the slurry inlet to the tailings outlet increased, and the spread of the distribution was reduced as the height of the baffle was raised relative to the interfaces. Thus more particulate material passed through the column at residence times which were close to the average residence time.

The applicant believes that a substantial improvement in residence time distribution and hence column recovery can be obtained in columns in which the interfaces are located below the top of the baffles. Furthermore the applicant believes that these columns will be able to be used as roughers and scavengers.

It will be appreciated that many modifications and/or variations of the invention are possible without departing from the spirit or scope of the invention.

I claim:

1. A method of reducing axial mixing within a flotation columm having a top and a bottom and, at least two separate upright passageways defined by baffle means having a top and a bottom, said column top being above the top of said baffle means top thereby defining a common zone above the baffle means, the method including the steps of:

a) feeding a feed slurry in parallel separately into each separate passageway to a location below the top of the baffle means from respective slurry feed means each located below the top of the baffle means within each passageway;

b) aerating the slurry in each passageway with air bubbles from aerating means spaced below each of said slurry feed means by directing said air bubbles upwardly through the slurry in each passageway and toward and past the respective slurry feed means to form a froth above the slurry in each passageway with the froth and slurry being separated from one another in each passageway by an interface; and c) maintaining the positions of the interfaces above the feed means and below the top of the baffle means in each passageway.

2. The method of claim 1 including the step maintaining the interfaces substantially level with one another.

3. The method of claim 2 including the steps of discharging the slurry from the passageways via tailings outlet means and maintaining the positions of the interfaces substantially level with one another by adjusting the position of one of the interfaces, by adjusting the rate of discharge from the tailings outlet means and by adjusting the position of the other interface or both interfaces by controlling the feed rate of the air bubbles and/or the feed rate of the slurry to the other passageway or passageways.

4. The method of claim 1 including the step of feeding the slurry at substantially the same level into each passageway from the respective slurry feed means.

5. The method of claim 1 including the step of overflowing the froth from the passageways into a common overflow zone.

6. The method of claim 1 including the step of discharging the slurry from the passageways via a common tailings outlet.

7. The method of claim 6 wherein the slurry is discharged from the passageways from a location below the bottom of said baffle means.

* * * * *